US005655451A

United States Patent [19]

Wasylczuk et al.

[11] Patent Number: 5,655,451

[45] Date of Patent: Aug. 12, 1997

[54] INTERFITTING STAMP SET FOR FAUX FINISHING

[76] Inventors: Carolyn C. Wasylczuk; Nick G. Wasylczuk, both of 3806 Swan House Ct., Burtonsville, Md. 20866

[21] Appl. No.: 557,317

[22] Filed: Nov. 14, 1995

[51] Int. Cl.[6] ..... B41L 47/02

[52] U.S. Cl. ..... 101/368; 101/405

[58] Field of Search ..... 101/201, 368, 101/379, 376, 405, 406, 103, 109; 40/328

[56] References Cited

U.S. PATENT DOCUMENTS

| | | | |
|---|---|---|---|
| 1,353,703 | 9/1920 | Babcock | 101/405 |
| 1,661,573 | 3/1928 | Mitchell | 101/379 |
| 1,696,010 | 12/1928 | Newman . | |
| 2,684,012 | 7/1954 | Hebert | 101/379 |
| 3,099,544 | 7/1963 | Sheesley | 101/379 |
| 3,180,260 | 4/1965 | Joseph . | |
| 3,446,143 | 5/1969 | Williamson | 101/379 |
| 3,597,099 | 8/1971 | Tollin | 101/406 |
| 3,817,178 | 6/1974 | Hagen . | |
| 4,030,414 | 6/1977 | McGuire . | |
| 4,182,241 | 1/1980 | Holtorf . | |
| 5,313,885 | 5/1994 | Winston | 101/405 |

FOREIGN PATENT DOCUMENTS

| | | | |
|---|---|---|---|
| 609618 | 9/1956 | Germany | 101/406 |

*Primary Examiner*—Ren Yan

*Attorney, Agent, or Firm*—Shoemaker and Mattare, Ltd.

[57] ABSTRACT

A interfitting stamp set for faux finishing includes a number of differently shaped stamps, wherein each stamp comprises, in a preferred form, a rigid backing, a handle applied to one surface of the backing, a layer of resilient foam material adhered to an opposite surface of the backing, and a rubbery ink transfer element adhered to the foam layer, the ink transfer element having an irregular pattern cut in relief on its surface away from the foam layer. The set is characterized in that the various stamps are all different, and have irregular peripheries comprising crests and valleys which nest at least partially within the crests and valleys of neighboring stamps when the stamps are placed together, whereby patterns with overlapping envelopes can be applied, without overlapping the stamps themselves.

4 Claims, 4 Drawing Sheets

INTERFITTING STAMP SET FOR FAUX FINISHING

BACKGROUND OF THE INVENTION

This invention relates generally to interior decorating and more particularly to an interfitting stamp set for faux finishing walls or other surfaces.

While walls are most commonly painted or wallpapered, they may be surface decorated in other ways. Stenciling has regained some popularity, and there are various surface texturing techniques. Another method of wall decoration is to apply patterns with ink- or paint-bearing rubber stamps or rollers.

In prior techniques employing stamped decorations, the stamps were usually applied in a regular array, usually a rectangular array as a consequence of the stamps having a polygonal shape, or from the use of a cylindrical roller. Regardless of whether a strict array was followed, the patterns applied simultaneously by neighboring stamps could not overlap, because of the stamps' shapes.

It is often better to apply neighboring patterns simultaneously, so that they do not actually overlap and possibly smudge or contaminate stamps with different colored inks.

We have observed that floral or other patterns are more pleasing when different elements of the pattern have overlapping envelopes; that is, where straight lines cannot be drawn between at least some neighboring patterns. Such overlapping, common in wallpaper designs, cannot be achieved with common rubber stamps.

Having recognized the desirability of achieving envelope overlapping in stamped designs, and having observed that overlapping cannot be obtained with polygonal stamps, we have developed a set of interfitting stamps as described below.

SUMMARY OF THE INVENTION

An object of the invention is to enable one to achieve new, visually pleasing overall designs from a set of decorative rubber stamps.

A related object of the invention is to produce a higher density of irregular patters such as leaves and flowers, than was heretofore possible with rubber stamps.

A further object of the invention is to prevent neighboring patterns from actually overlapping, resulting in smudges and color contamination.

These and other objects are attained by an interfitting stamp set for faux finishing, wherein each stamp comprises a rigid backing, a handle applied to one surface of the backing, a layer of resilient foam material adhered to an opposite surface of the backing, and a rubbery ink transfer element adhered to the foam layer, the ink transfer element having an irregular pattern cut in relief on its surface away from the foam layer. The set is characterized in that the various stamps are all different, and have irregular peripheries comprising crests and valleys which nest at least partially within the crests and valleys of neighboring stamps when the stamps are placed together, whereby patterns with overlapping envelopes can be applied, without overlapping the patterns themselves.

BRIEF DESCRIPTION OF THE DRAWINGS

In the accompanying drawings.

DESCRIPTION OF THE PREFERRED EMBODIMENT

Figure 1:
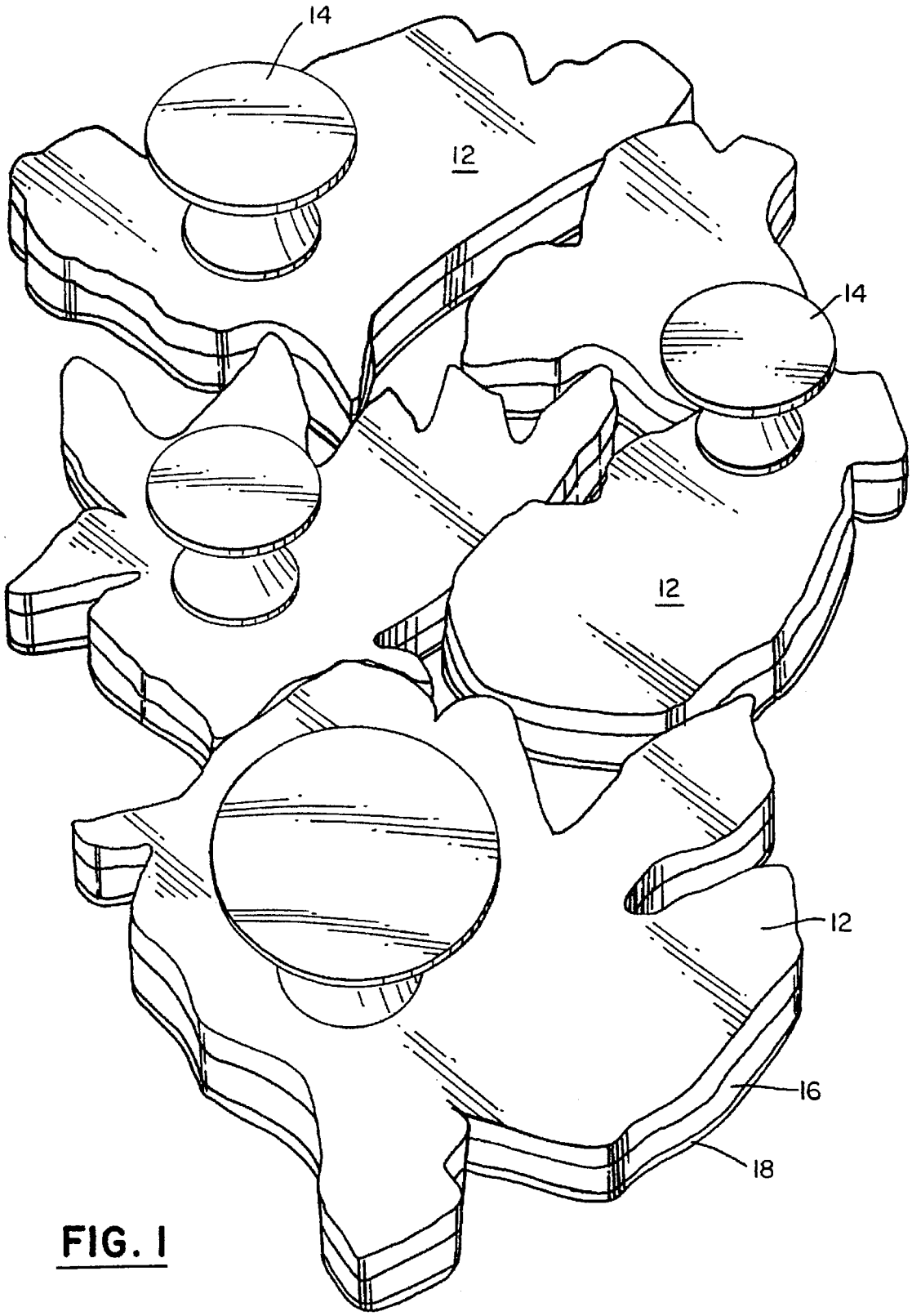
FIG. 1 is an isometric view, from above, of an interfitting stamp set for faux finishing.
Figure 2:
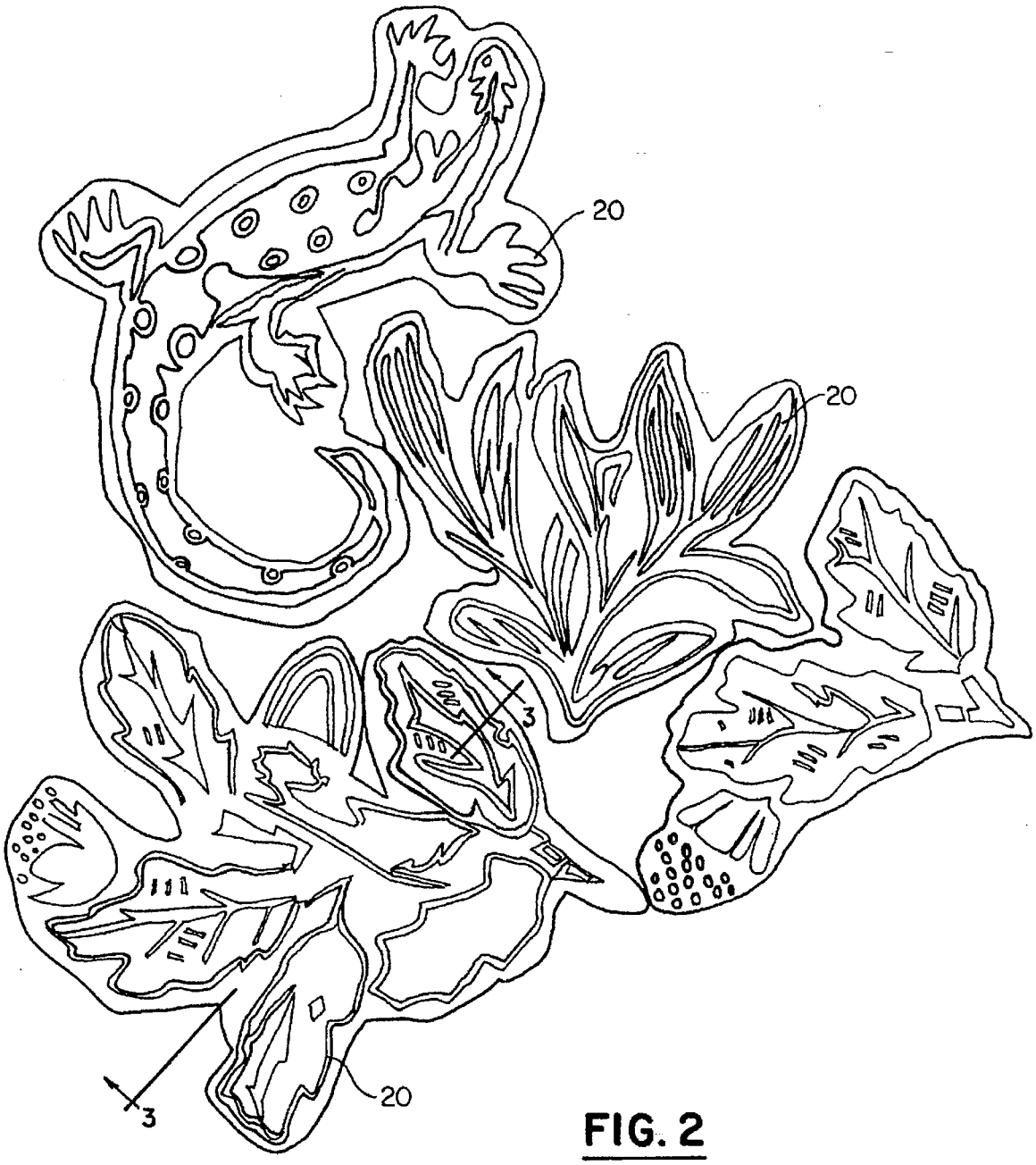
FIG. 2 is a bottom plan view thereof.
Figure 3:
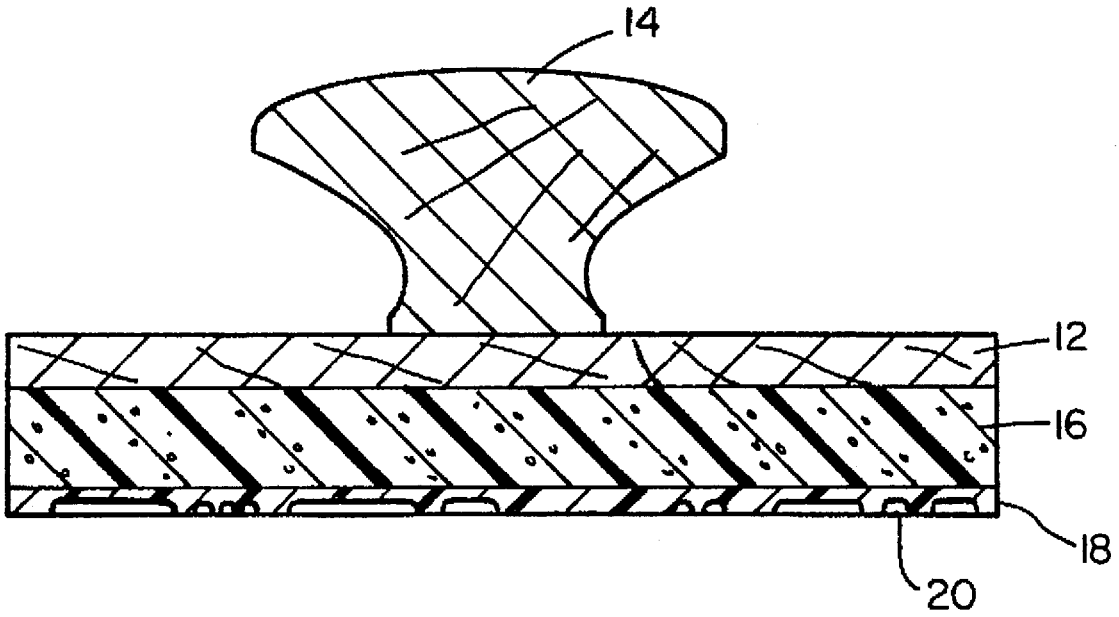
FIG. 3 is a sectional view of one stamp, taken on the plane 3—3 in FIG. 2.

An interfitting stamp set for faux finishing embodying the invention includes a number of individual stamps. The set is shown in FIGS. 1 and 2; FIG. 3 a cross-section of a single stamp.

One can see, in FIG. 1, the rigid backing members 12, and the handles 14 affixed to the upper surface of each stamp. A resilient foam layer 16, and a rubbery in transfer element 18, are easier to see in FIGS. 2 and 3. Patterns 20 (FIG. 3) are formed on the lower surfaces of the stamping elements by laser cutting or other methods.

In a presently preferred form of the invention, the rigid backing members 12 are cut from quarter-inch plywood, and the handles are turned wooden drawer pulls. The foam layer is cut from a sheet of soft foam rubber, and the rubbery ink transfer elements are cut from eighth-inch stock material which may be natural rubber or a silicone rubber or a soft plastic capable of carrying ink or paint. The layers are held together by suitable adhesives, whose choice will depend on the exact nature of the materials, and is a matter of ordinary skill.

It is preferred to make up the three-layer laminate described in large sheets, lay out and cut the patterns of neighboring stamps, and then cut out individual envelopes around the patterns. (The envelopes are illustrated by broken lines in FIG. 4, since they do not actually appear on the resulting decorated wall surface.) Then handles are affixed to the resulting individual stamps.

To produce the invention in quantity, it may prove preferable to injection mold individual stamps, or layered stock material, from a material which can be foamed in the mold. Techniques are known for injecting foamable materials in such a way that the resulting product has greatly varying density across the thickness of the product. With such techniques, those of skill in this field may be able to produce monolithic stamps, or at least stamps in which two of the layers are integrated.

Figure 4:
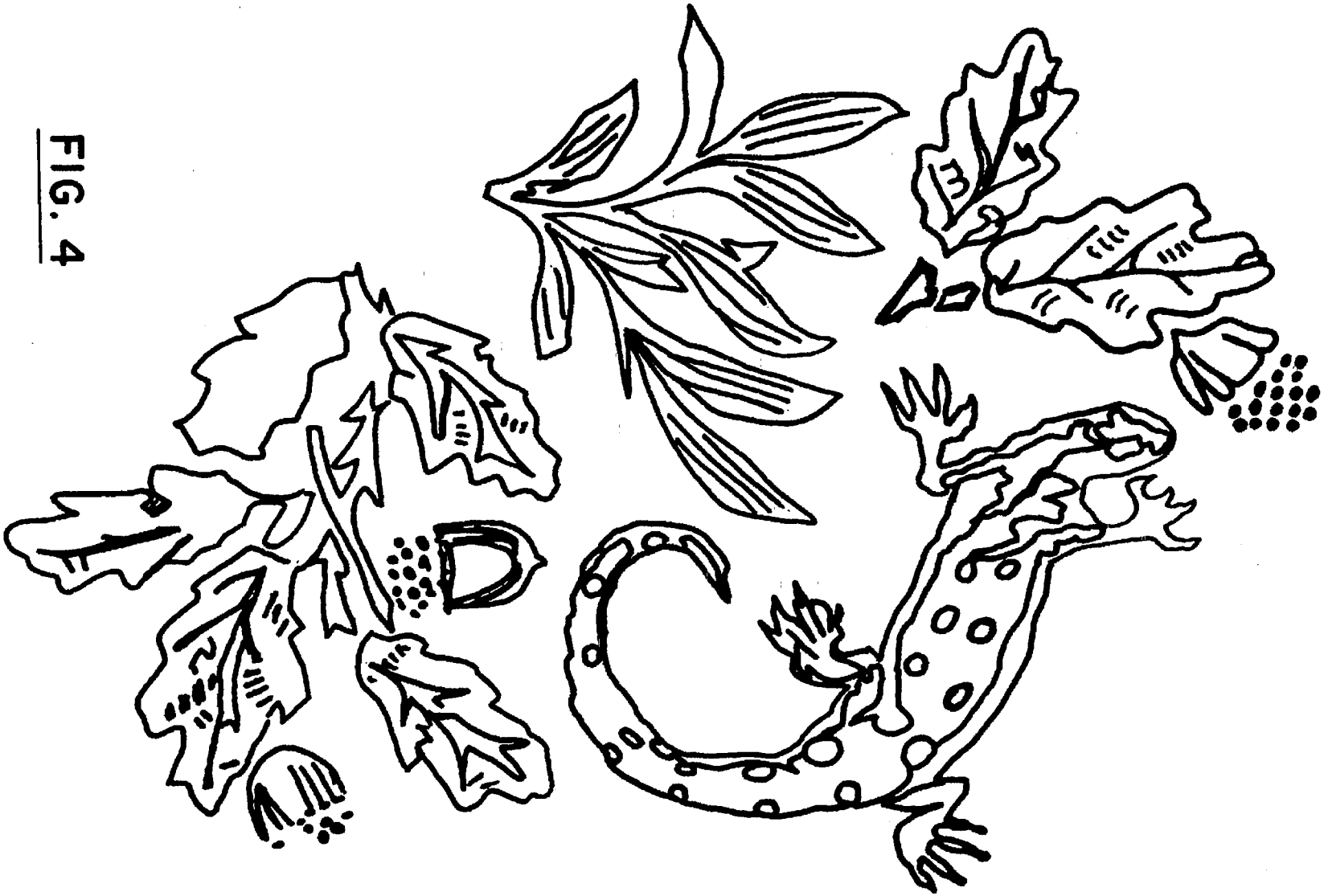
FIG. 4 is a copy of a printed pattern produced with the stamp set.

FIG. 4 shows a sample pattern produced by applying the stamps, inked, to a substrate. One stamp is left in contact with the substrate while its neighbor is positioned, to prevent the patterns from overlapping. Nevertheless, the envelopes of the patterns overlap, by which we means that straight lines cannot be drawn between all, or at least some, of them, without intersecting the patterns.

While the handles and rigid backings are preferred, to distribute hand pressure over the surface of the stamp, it is possible that they may dispensed with for purposes of economy. Likewise, the rubbery ink transfer element may not be necessary in some situations, where only outlines need to be produced.

Since the invention is subject to modifications and variations, it is intended that the foregoing description and the accompanying drawings shall be interpreted as illustrative of only one form of the invention, whose scope is to be measured by the following claims.

We claim:

1. An interfitting stamp set for decorative faux finishing and crafts, said set comprising a number of differently shaped stamps, wherein each stamp comprises a rigid backing, a resilient foam layer having the same shape as the rigid backing, applied to one side of the backing, and a handle attached to the other side of the backing, wherein the various stamps are all different and independent, without interconnection, and said rigid backings and said foam layers have irregular peripheries comprising crests and valleys which nest at least partially within crests and valleys of neighboring stamps when the stamps are placed closely adjacent one another, whereby patterns with overlapping envelopes can be applied, without overlapping the stamps themselves.

2. The invention of claim 1, wherein each stamp further comprises a rubbery ink transfer element adhered to the foam layer opposite the backing, the ink transfer element having an irregular pattern whose shape corresponds to that of the backing member cut in relief on its surface away from the foam layer.

3. The invention of claim 1, wherein the backing material and the foam layer are integral.

4. The invention of claim 1, wherein the crests and valleys interfit sufficiently that straight lines cannot be drawn between at least some of the resulting patterns.

* * * * *